US008626422B2

(12) United States Patent
Bedard et al.

(10) Patent No.: US 8,626,422 B2
(45) Date of Patent: Jan. 7, 2014

(54) ELECTRONIC OIL PUMP

(71) Applicant: Bombardier Recreational Products Inc., Valcourt (CA)

(72) Inventors: Yvon Bedard, Orford (CA); Benoit Pion, Valcourt (CA)

(73) Assignee: Bombardier Recreational Products, Inc., Valcourt (CA)

( * ) Notice: Subject to any disclaimer, the term of this patent is extended or adjusted under 35 U.S.C. 154(b) by 0 days.

(21) Appl. No.: 13/852,564

(22) Filed: Mar. 28, 2013

(65) Prior Publication Data

US 2013/0238221 A1 Sep. 12, 2013

Related U.S. Application Data

(62) Division of application No. 12/678,308, filed as application No. PCT/US2009/059007 on Sep. 30, 2009, now Pat. No. 8,428,846.

(51) Int. Cl.

| | |
|---|---|
| ***G06F 19/00*** | (2011.01) |
| ***F01M 3/00*** | (2006.01) |
| ***F01M 1/02*** | (2006.01) |
| ***F01M 11/00*** | (2006.01) |

(52) U.S. Cl.
USPC ..... 701/102; 123/73 AD; 123/196 S; 702/94; 73/53.05

(58) Field of Classification Search
USPC ..... 701/102; 702/94; 123/73 AD, 196 R, 123/196 S; 184/1.5; 73/53.05; 440/88 L
See application file for complete search history.

(56) References Cited

U.S. PATENT DOCUMENTS

| | | | |
|---|---|---|---|
| 2,755,966 | A | 7/1956 | Herman |
| 3,692,438 | A | 9/1972 | Schapel |
| 3,934,238 | A | 1/1976 | Pavlou |
| 4,028,014 | A | 6/1977 | Cocks |

(Continued)

FOREIGN PATENT DOCUMENTS

| | | | |
|---|---|---|---|
| EP | 0622528 | A1 | 11/1994 |
| EP | 1258424 | A2 | 11/2002 |

(Continued)

OTHER PUBLICATIONS

International Search Report of PCT/US2009/059007; Feb. 5, 2010; Nikolaos Fistas.

(Continued)

*Primary Examiner* — Mahmoud Gimie
*Assistant Examiner* — David Hamaoui
(74) *Attorney, Agent, or Firm* — BCF LLP

(57) ABSTRACT

An electronic oil pump has at least one lubricant inlet, at least one lubricant outlet, at least one piston being movable between a full stroke position and a fully retracted position, an electrical actuator operatively connected to the at least one piston, a first electrical lead connected to a first element of the pump for electrically connecting the first element to an electronic control unit (ECU), and a second electrical lead connected to a second element of the pump for electrically connecting the second element to the ECU. When the at least one piston is in the full stroke position, an electrical path between the first and second electrical leads is closed. When the at least one piston is in a position other than the full stroke position, the electrical path is opened. A method of controlling an engine having the oil pump is also disclosed.

4 Claims, 10 Drawing Sheets

(56) References Cited

U.S. PATENT DOCUMENTS

| | | | | |
|---|---|---|---|---|
| 4,684,062 | A | 8/1987 | Bagwell | |
| 4,701,112 | A | 10/1987 | Eisenhut et al. | |
| 5,800,139 | A | 9/1998 | Yamada | |
| 5,904,126 | A * | 5/1999 | McKay et al. | 123/196 S |
| 5,934,242 | A * | 8/1999 | Anamoto | 123/196 R |
| 6,095,769 | A | 8/2000 | McKay | |
| 6,964,254 | B1 | 11/2005 | Koerner et al. | |
| 7,150,249 | B2 * | 12/2006 | Kato | 123/73 AD |
| 8,127,597 | B2 * | 3/2012 | Staley et al. | 73/53.05 |
| 2002/0148662 | A1 | 10/2002 | Ashida et al. | |
| 2003/0216093 | A1 * | 11/2003 | Koerner et al. | 440/88 L |
| 2010/0163327 | A1 | 7/2010 | Bernier et al. | |

FOREIGN PATENT DOCUMENTS

| | | | |
|---|---|---|---|
| RU | 2105161 | C1 | 2/1998 |
| SU | 1562482 | A1 | 5/1990 |
| WO | 9300502 | A1 | 1/1993 |
| WO | 2009002572 | A1 | 12/2008 |

OTHER PUBLICATIONS

English Abstract of SU1562482, Published May 7, 1990, Pilyugin et al.

* cited by examiner

ELECTRONIC OIL PUMP

FIELD OF THE INVENTION

The present invention relates to an electronic oil pump and a method of controlling an engine to which lubricant is supplied by the oil pump.

BACKGROUND OF THE INVENTION

Snowmobiles conventionally have a lubrication system that uses an oil pump that is mechanically driven by an engine of the snowmobile. This type of oil pump is generally referred to as a mechanical oil pump.

When the engine operates on a four-stroke principle, the lubricant is stored in an oil tank that is usually connected or integrated to the engine, such as an oil pan. The mechanical oil pump pumps the lubricant from the oil tank to make it circulate through the engine. After circulating through the engine, the lubricant is returned to the oil tank.

When the engine operates on a two-stroke principle, the lubricant is stored in an oil tank that is usually spaced apart from the engine. The mechanical oil pump pumps the lubricant from the oil tank to the crankcase of the engine. From the crankcase, the lubricant flows to the cylinders where it is combusted with a mixture of fuel and air. Since the lubricant is combusted by the engine, the oil tank occasionally needs to be refilled with lubricant for the engine to operate properly.

By having the mechanical oil pump driven by the engine, the amount of lubricant being pumped is directly proportional to the speed of the engine. Therefore, the faster the engine turns, the more lubricant is being pumped by the mechanical oil pump, and the relationship between engine speed and the amount of lubricant being pumped is a linear one. However, the actual lubricant requirements of an engine, especially in the case of an engine operating on a two-stroke principle, are not linearly proportional to the engine speed.

Some mechanical oil pumps driven by the engine are also linked to the throttle lever that is operated by the driver of the vehicle, such that the position of the throttle lever adjusts the output of the mechanical oil pump. Although this provides for an improved supply of lubricant to the engine, it does not account for other factors which affect the actual lubricant requirements of the engine such as ambient air temperature and altitude.

For a two-stroke engine, the actual lubricant requirement depends, at least in part, on the power output of the engine, not only engine speed. The higher the power output, the more lubricant is required. There are instances during the operation of the two-stroke engine where the engine speed is high, but where the power output of the engine is low. In such instances, the mechanical oil pump driven by the engine provides a lot of lubricant even though the actual requirements are low. One such instance is when the track of the snowmobile is slipping on a patch of ice. In this instance the engine speed is high due to the slippage, but the actual power output is low. There are other instances where the actual lubricant requirements are lower than what would be provided by a mechanical oil pump driven by the engine. For example, at start-up, all of the lubricant that was present in the engine when it was stopped has accumulated at the bottom of the crankcase. The accumulated lubricant would be sufficient to lubricate the engine for the first few minutes of operation, however the mechanical oil pump, due to its connection to the engine, adds lubricant regardless. Therefore, in the case of an engine operating on the two-stoke principle, using a mechanical oil pump results in more lubricant being consumed by the engine than is actually required. This also results in a level of exhaust emissions that is higher than a level of exhaust emissions that would result from supplying the engine with its actual lubricant requirements since more lubricant gets combusted than is necessary.

The actual lubricant requirements of an engine for a snowmobile are also a function of one or more of the altitude at which the snowmobile is operating, the engine temperature, and the position of the throttle lever, to name a few. Since snowmobiles are often operated in mountainous regions and that temperatures can vary greatly during the winter, the actual lubricant requirements of the engine can be significantly affected by these factors and therefore need to be taken into account. Conventional snowmobile lubrication systems using mechanical oil pumps, due to the linear relationship between the engine speed and the amount of lubricant being pumped, cannot take these into account.

In the prior art, mechanisms were provided on some snowmobiles which would modify the amount of lubricant provided by the oil pump per engine rotation. These mechanisms provided two (normal/high, or normal/low) or three (normal/high/low) oil pump settings. Although these settings provided some adjustment in the amount of lubricant being provided to the engine by the oil pump, since the pump is still mechanically connected to the engine, the relationship is still a linear one, and thus does not address all of the inconveniences described above. The settings simply provide consistently more or less lubricant, as the case may be, than at the normal settings.

Therefore, there is a need for an oil pump that can provide an engine, such as the engine of a snowmobile, with an amount of lubricant that is at or near the actual lubricant requirements of the engine.

There is also a need for an oil pump that can supply lubricant to an engine, such as the engine of a snowmobile, non-linearly with respect to the engine speed and other factors.

Finally, since snowmobiles are used during the winter, the low ambient temperature causes the lubricant to be very viscous when the engine is first started and becomes less viscous as the engine warms up (thereby warming the lubricant), thus affecting the efficiency with which the lubricant can be pumped. Therefore, when the lubricant has a high viscosity, the oil pump may be unable to supply the amount of lubricant necessary for the proper operation of the engine under certain conditions. Also, different lubricants, at the same temperature, have different viscosities. Therefore, similar issues may be associated with lubricants having a normally high viscosity.

Therefore, there is also a need for an oil pump that can take into account varying lubricant viscosities and a method of use thereof.

SUMMARY OF THE INVENTION

It is an object of the present invention to ameliorate at least some of the inconveniences present in the prior art.

It is also an object of the present invention to provide an electronic oil pump that can provide a feedback signal representative of lubricant viscosity.

The feedback signal corresponds to a stroke time of the electronic oil pump. A longer stroke time is representative of a higher oil viscosity.

It is another object to provide a method of controlling an engine to which lubricant is supplied by the electronic oil pump. By being able to determine a viscosity of the lubricant from the stroke time of the oil pump, an electronic control unit (ECU) associated with the engine limits the maximum engine speed of the engine to a level at which lubricant can be sufficiently provided by the oil pump. More specifically, from the stroke time, the ECU can determine the cycle time of the pump (stroke time plus return time) and therefore the maximum frequency of operation of the oil pump. The ECU can then limit the maximum speed of the engine such that it is at or below an engine speed for which this maximum frequency of operation of the oil pump can supply a sufficient amount of lubricant.

In one aspect, the invention provides an electronic oil pump adapted to be controlled by an electronic control unit (ECU). The oil pump has at least one lubricant inlet, at least one lubricant outlet, at least one piston being movable between a full stroke position and a fully retracted position to pump lubricant from the at least one inlet to the at least one outlet, an electrical actuator operatively connected to the at least one piston for moving the at least one piston to the full stroke position, a first electrical lead connected to a first element of the pump for electrically connecting the first element to the ECU, and a second electrical lead connected to a second element of the pump for electrically connecting the second element to the ECU. When the at least one piston is in the full stroke position, an electrical path between the first and second electrical leads is closed. When the at least one piston is in a position other than the full stroke position, the electrical path between the first and second electrical leads is opened.

In a further aspect, a body houses the at least one piston. A piston carrier is operatively connected to the actuator. The piston carrier is made of electrically conductive material. The at least one piston is mounted to the piston carrier. The piston carrier moves with the at least one piston between the full stroke position and the fully retracted position. A stopper is disposed in the body. The stopper is made of electrically conductive material. The piston carrier contacts the stopper when the at least one piston is in the full stroke position. A housing houses the actuator. The housing is made of electrically conductive material. The first element is the stopper and the second element is the housing.

In an additional aspect, at least one fastener fastens the housing to the body. The at least one fastener is made of electrically conductive material. The second lead is electrically connected to the at least one fastener.

In a further aspect, the body is made of electrically insulating material.

In an additional aspect, a pole is disposed between the actuator and the piston carrier. The pole is made of electrically conductive material. The piston carrier contacts the pole when the at least one piston is in the fully retracted position. A third electrical lead is electrically connected to the piston carrier for electrically connecting the piston carrier to the ECU. When the at least one piston is in the fully retracted position, an electrical path between the second and third electrical leads is closed. When the at least one piston is in a position other than the fully retracted position, the electrical path between the second and third electrical leads is opened.

In a further aspect, a spring is disposed between the piston carrier and the stopper. The spring biases the piston carrier toward the fully retracted position. A cap is disposed on an end of the spring between the spring and the stopper. The cap is made of electrically insulating material. The cap provides electrical insulation between the stopper and the spring.

In an additional aspect, the cap is a first cap, and the actuator includes a plunger engaging the piston carrier. The oil pump also has a third electrical lead electrically connected to the piston carrier for electrically connecting the piston carrier to the ECU, and a second cap disposed on an end of the plunger between the plunger and the piston carrier. The second cap being made of electrically insulating material. The second cap providing electrical insulation between the piston carrier and the actuator. When the at least one piston is in the fully retracted position, an electrical path between the second and third electrical leads is closed. When the at least one piston is in a position other than the fully retracted position, the electrical path between the second and third electrical leads is opened.

In a further aspect, a third electrical lead is connected to a third element of the pump for electrically connecting the third element to the ECU. When the at least one piston is in the fully retracted position, an electrical path between the second and third electrical leads is closed. When the at least one piston is in a position other than the fully retracted position, the electrical path between the second and third electrical leads is opened.

In an additional aspect, the at least one outlet includes a first pair of outlets.

In a further aspect, the at least one outlet further includes a second pair of outlets.

In an additional aspect, the actuator includes an electromagnetic coil.

In another aspect, the invention provides a method of controlling an engine having an electronic oil pump supplying lubricant thereto. The electronic oil pump includes an actuator operatively connected to at least one piston. The method comprises: causing the actuator to move the at least one piston toward a full stroke position; sending a signal to an electronic control unit (ECU) when the at least one piston reaches the full stroke position; determining a time taken to reach the full stroke position based on the signal; estimating a time for returning the at least one piston to a fully retracted position based on the time taken to reach the full stroke position; determining a cycle time of the pump based the time taken to reach the full stroke position and the estimated time for returning the at least one piston to the fully retracted position; returning the at least one piston to the fully retracted position; and limiting a maximum allowable engine speed based at least in part on the cycle time.

In a further aspect, the actuator includes an electromagnetic coil. Causing the actuator to move the at least one piston toward a full stroke position includes applying a current to the electromagnetic coil. Returning the at least one piston to the fully retracted position includes stopping to apply the current to the electromagnetic coil.

In an additional aspect, the method further comprises applying the current to the electromagnetic coil for longer than is necessary to move the at least one piston toward the full stroke position.

In a further aspect, the method further comprises operating the engine in a fault mode if the signal is not received by the ECU within a predetermined amount of time.

In yet another aspect, the invention provides another method of controlling an engine having an electronic oil pump supplying lubricant thereto. The electronic oil pump includes an actuator operatively connected to at least one piston. The method comprises: causing the actuator to move the at least one piston toward a full stroke position; sending a first signal to an electronic control unit (ECU) when the at least one piston reaches the full stroke position; determining a time taken to reach the full stroke position based on the first signal; returning the at least one piston to the fully retracted position; sending a second signal to the ECU when the at least one piston reaches a fully retracted position; determining a time taken for returning the at least one piston to the fully retracted position based on the second signal; determining a cycle time of the pump based the time taken to reach the full stroke position and the time taken for returning the at least one piston to the fully retracted position; and limiting a maximum allowable engine speed based at least in part on the cycle time.

In an additional aspect, the actuator includes an electromagnetic coil. Causing the actuator to move the at least one piston toward a full stroke position includes applying a current to the electromagnetic coil. Returning the at least one piston to the fully retracted position includes stopping to apply the current to the electromagnetic coil.

In a further aspect, the method further comprises applying the current to the electromagnetic coil for longer than is necessary to move the at least one piston toward the full stroke position.

In an additional aspect, the method further comprises operating the engine in a fault mode if the first signal is not received by the ECU within a predetermined amount of time.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

The present invention will be described in combination with a snowmobile. However it is contemplated that at least some aspects of the present invention could be used in other applications.

Figure 1:
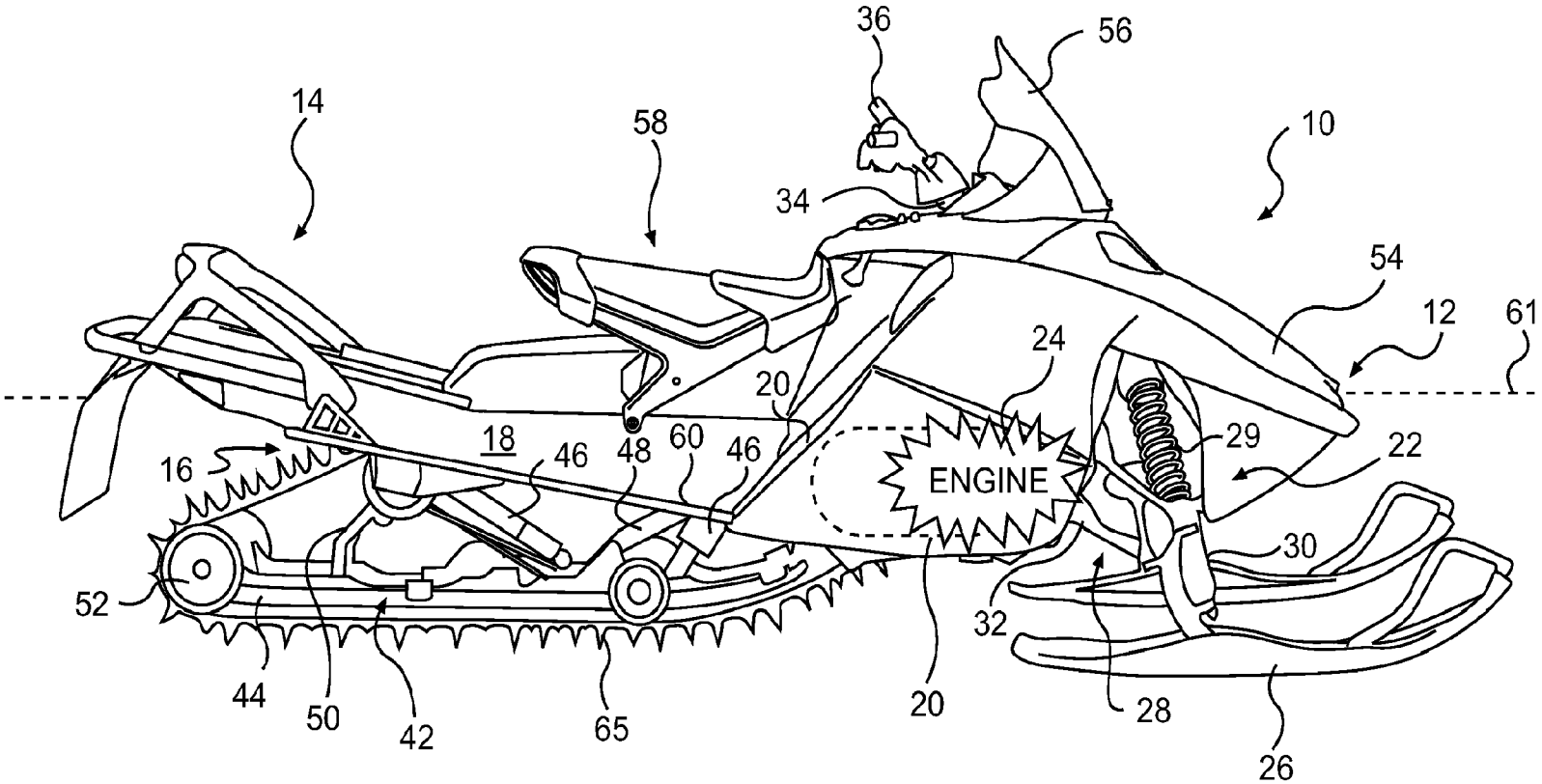
FIG. 1 is a right side elevation view of a snowmobile in accordance with the invention.

FIG. 1 illustrates a snowmobile 10 including a forward end 12 and a rearward end 14 which are defined consistently with a travel direction of the snowmobile 10. The snowmobile 10 includes a frame 16 which includes a tunnel 18 and an engine compartment 20. A front suspension 22 is connected to the frame. The tunnel 18 generally consists of one or more pieces of sheet metal bent to form an inverted U-shape. The tunnel 18 extends rearwardly along the longitudinal centerline 61 of the snowmobile 10 and is connected at the front to the engine compartment 20. An engine 24, which is schematically illustrated in FIG. 1, is carried by the engine compartment 20 of the frame 16. A steering assembly (not indicated) is provided, in which two skis 26 are positioned at the forward end 12 of the snowmobile 10 and are attached to the front suspension 22 through a pair of front suspension assemblies 28. Each front suspension assembly 28 includes a ski leg 30, a pair of A-arms 32 and a shock absorber 29 for operatively connecting the respective skis 26 to a steering column 34. Other types of front suspension assemblies 28 are contemplated, such as a swing-arm or a telescopic suspension. A steering device such as a handlebar 36, positioned forward of a rider, is attached to the upper end of the steering column 34 to allow the rider to rotate the ski legs 30 and thus the skis 26, in order to steer the snowmobile 10.

An endless drive track 65 is positioned at the rear end 14 of the snowmobile 10. The endless drive track 65 is disposed generally under the tunnel 18, and is operatively connected to the engine 24. The endless drive track 65 is driven to run about a rear suspension assembly 42 for propelling the snowmobile 10. The rear suspension assembly 42 includes a pair of slide rails 44 in sliding contact with the endless drive track 65. The rear suspension assembly 42 also includes one or more shock absorbers 46 which may further include a coil spring (not shown) surrounding the individual shock absorbers 46. Suspension arms 48 and 50 are provided to attach the slide rails 44 to the frame 16. One or more idler wheels 52 are also provided in the rear suspension assembly 42.

At the front end 12 of the snowmobile 10, fairings 54 enclose the engine 24, thereby providing an external shell that not only protects the engine 24, but can also be decorated to make the snowmobile 10 more aesthetically pleasing. Typically, the fairings 54 include a hood (not indicated) and one or more side panels which can be opened to allow access to the engine 24 when this is required, for example, for inspection or maintenance of the engine 24. In the particular snowmobile 10 shown in FIG. 1, the side panels can be opened along a vertical axis to swing away from the snowmobile 10. A windshield 56 is connected to the fairings 54 near the front end 12 of the snowmobile 10. Alternatively the windshield 56 can be connected directly to the handlebar 36. The windshield 56 acts as a wind screen to lessen the force of the air on the rider while the snowmobile 10 is moving.

A straddle-type seat 58 is positioned atop the frame 16. A rear portion of the seat 58 may include a storage compartment or can be used to accommodate a passenger seat (not indicated). Two footrests 60 are positioned on opposite sides of the snowmobile 10 below the seat 58 to accommodate the driver's feet.

Figure 2:
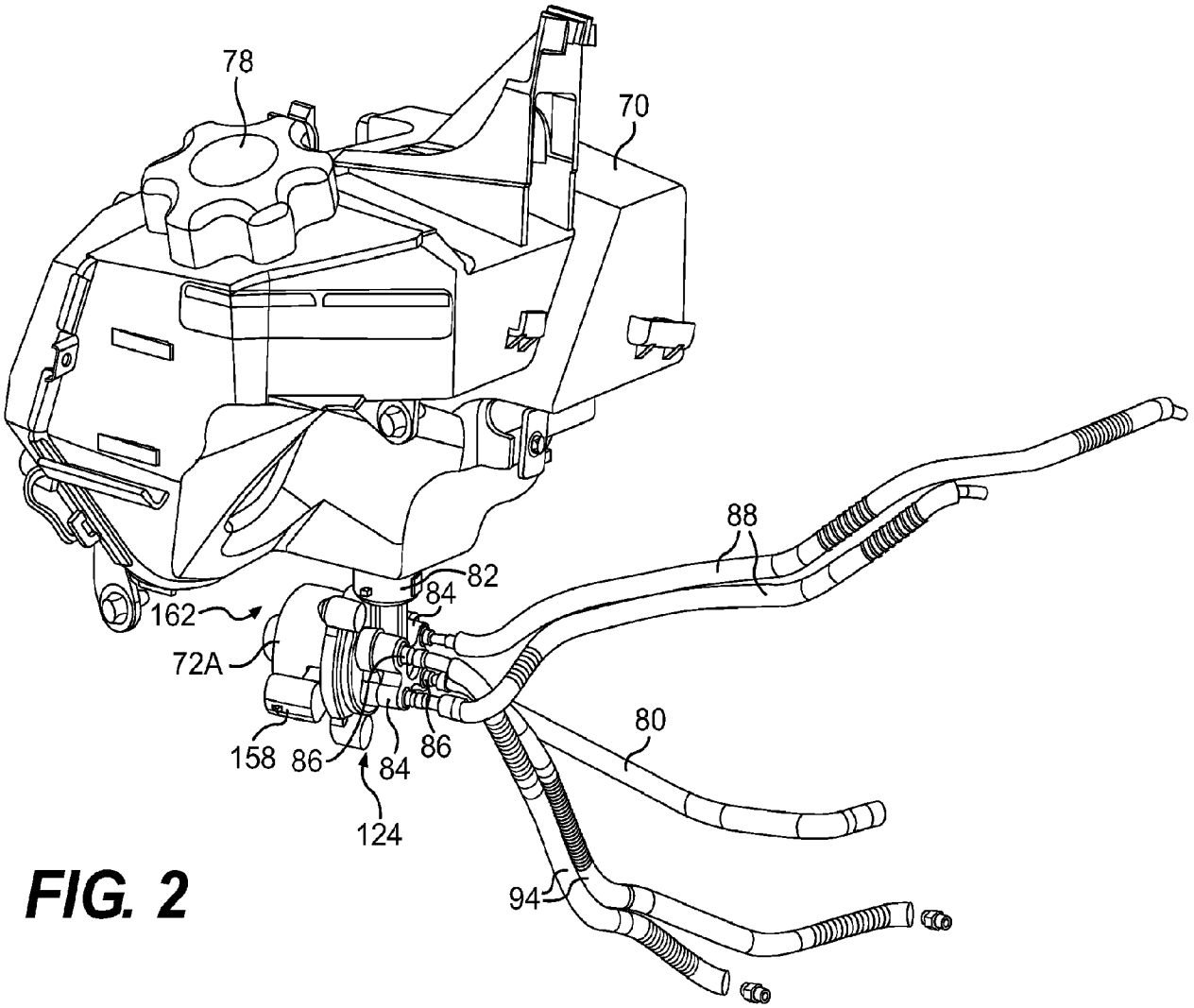
FIG. 2 is a perspective view from a front, right side, of an oil tank and electronic oil pump assembly to be used in the snowmobile of FIG. 1.
Figure 3:
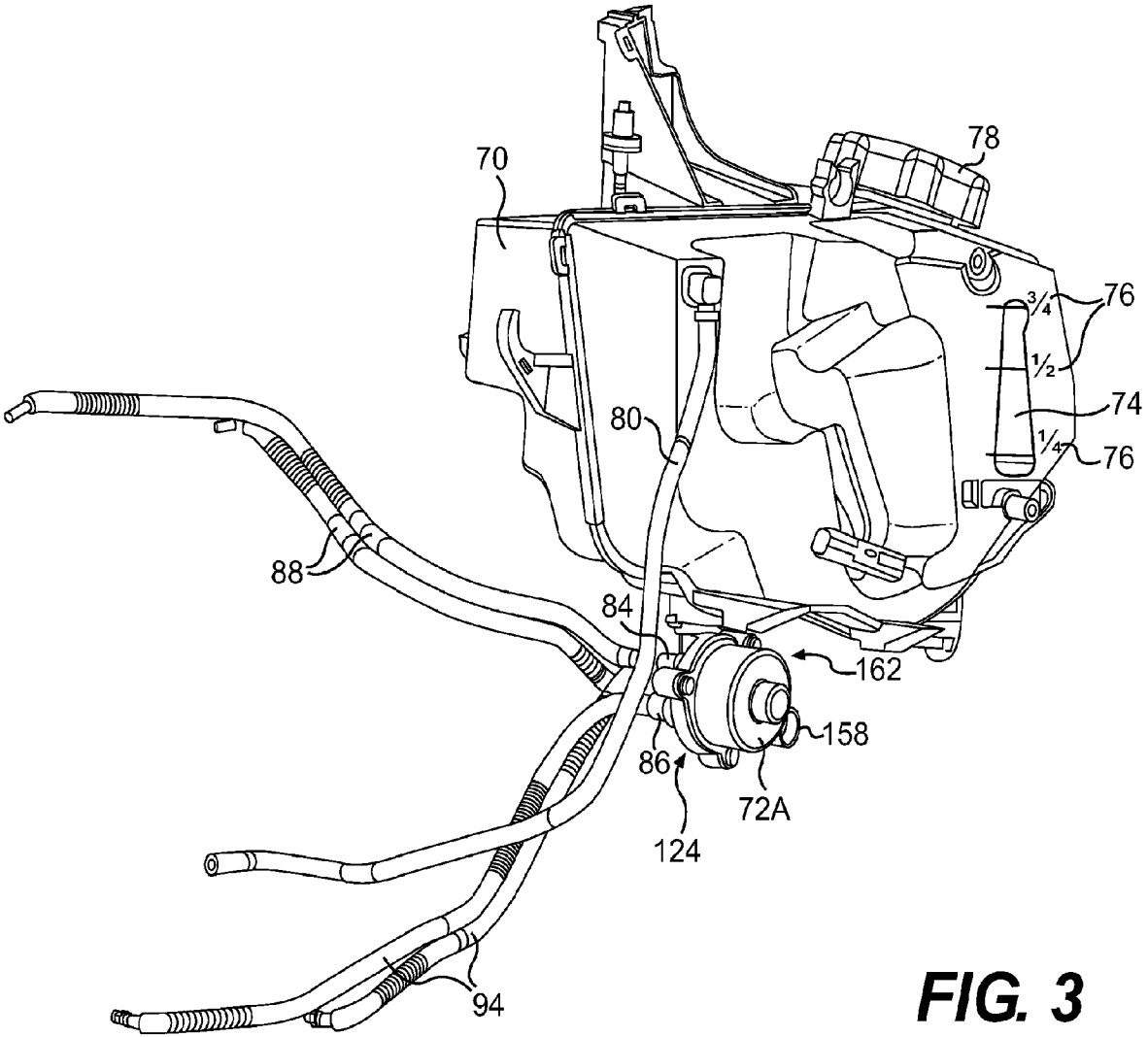
FIG. 3 is a perspective view from a rear, left side, of the oil tank and electronic oil pump assembly of FIG. 2.

Turning now to FIGS. 2 and 3, the lubrication system of the snowmobile 10 includes an oil tank 70 and an electronic oil pump 72A. The oil tank 70 is disposed in the engine compartment 20 (see FIG. 4) and is shaped so as to fit between the various other components located in the engine compartment 20. The oil tank 70 is preferably fixed to the frame 18 and is preferably positioned slightly behind the engine 24. Since the oil tank 70 is not directly connected to the engine 24, the oil tank 70 is partially isolated from the vibration generated by the engine 24. The oil tank 70 is preferably made of plastic. As seen in FIG. 3, a portion 74 of the oil tank 70 is translucent to permit visible inspection as to the level of lubricant in the oil tank 70. Level markers 76 provide a visual indication as to the relative level of lubricant in the tank 70. A cap 78 is provided to open or close an oil filling opening (not shown) on the oil tank 70. A hose 80 extends from an upper portion of the oil tank 70 to a component of the engine 24, such as a water pump (not shown), to provide lubricant thereto. When the oil tank 70 is filled up above the level of the upper end of the hose 80, the hose 80 is filled with lubricant. The lubricant present in the hose 80 is then gradually fed by gravity to the component to which the hose 80 is connected. The volume of lubricant in the hose 80 is preferably sufficient to provide lubricant to the component until the oil tank 70 is once again filled up above the level of the upper end of the hose 80.

Figure 4:
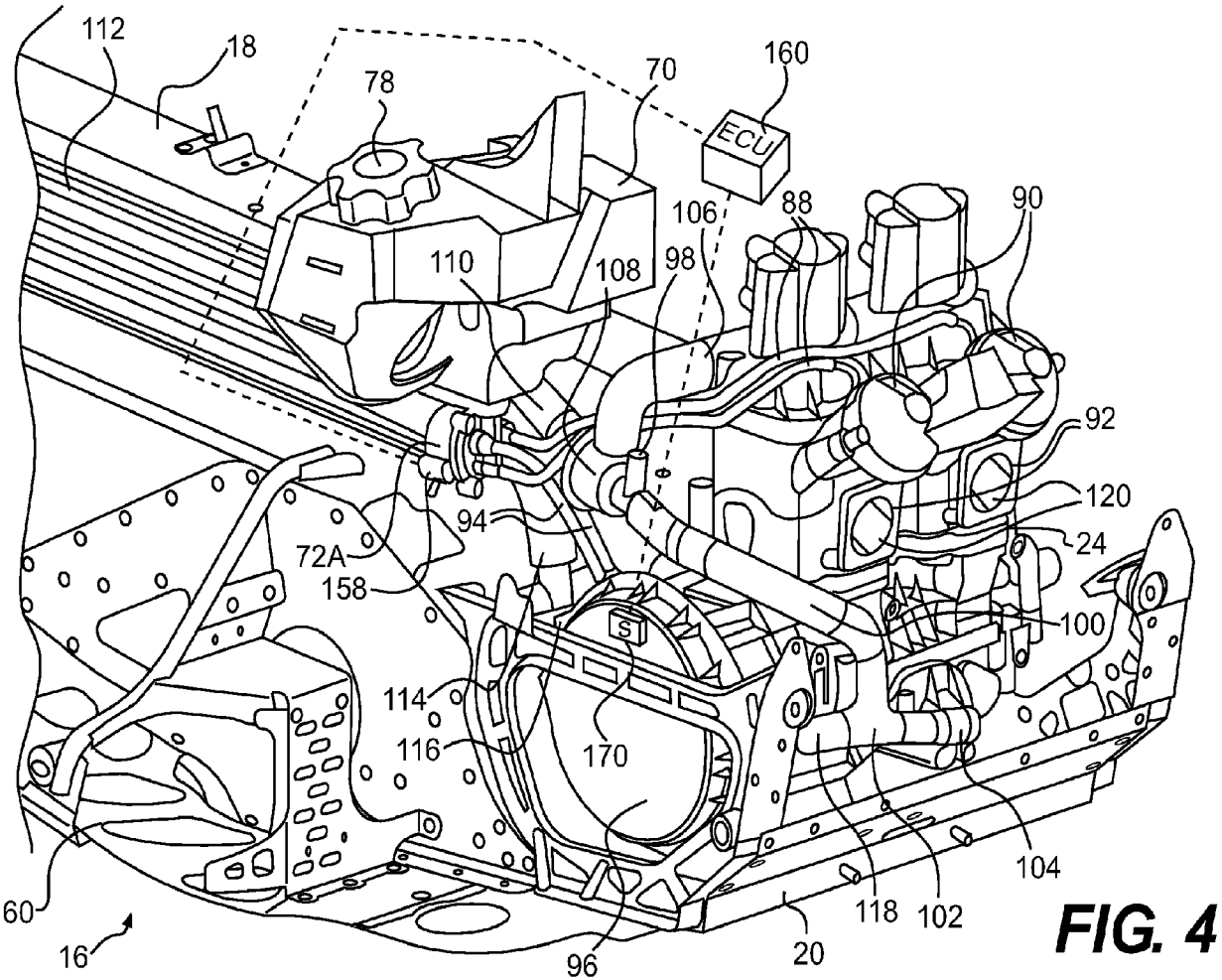
FIG. 4 is a perspective view from a front, right side, of internal components of the snowmobile of FIG. 1, with some of the components removed for clarity.
Figure 8:
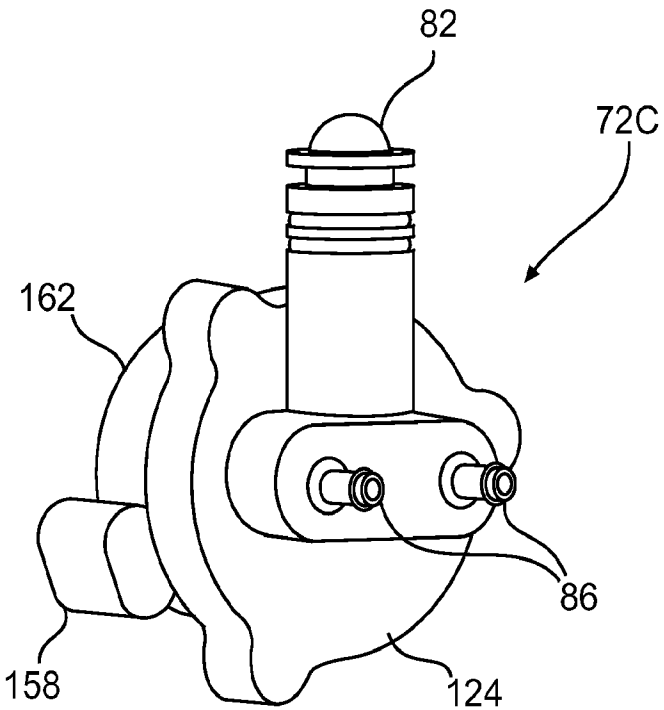
FIG. 8 is a perspective view from a front, right side, of the electronic oil pump of FIG. 7.
Figure 7:
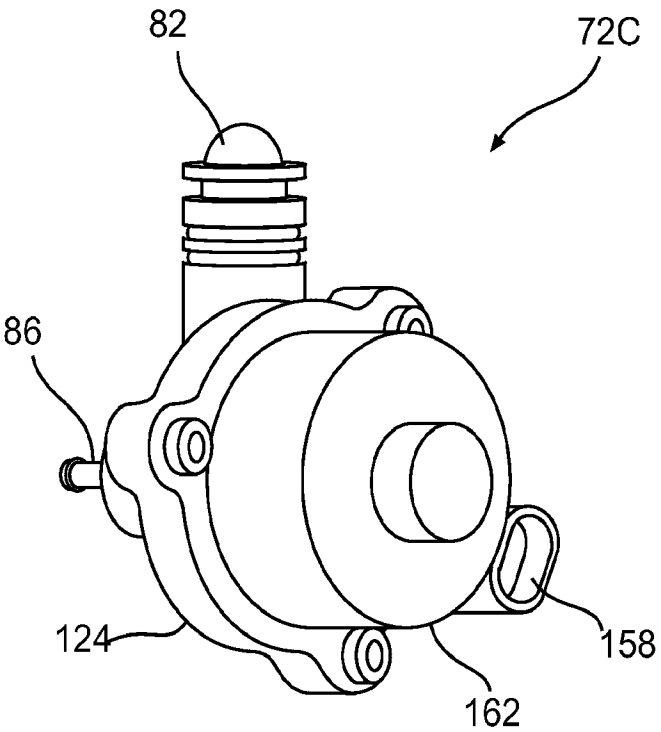
FIG. 7 is a perspective view from a rear, left side, of an alternative embodiment of the electronic oil pumps of FIG. 6A and 6B.

As can also be seen in FIGS. 2 and 3 the electronic oil pump 72A is disposed externally of the oil tank 70. An inlet 82 of the electronic oil pump 72A is connected directly to a bottom of the oil tank 70 on a side of the oil tank 70 opposite the side of the oil filling opening. The inlet 82 is preferably connected to the lowest point of the oil tank 70. The electronic oil pump 72A has four outlets 84, 86. The two outlets 84 are connected to hoses 88. As seen in FIG. 4, the hoses 88 are connected to the two exhaust valves 90 of the engine 24 (one exhaust valve 90 per cylinder 92.) to supply lubricant thereto. One possible construction of the exhaust valves 90 is described in U.S. Pat. No. 6,244,227, issued Jun. 12, 2001, incorporated herein by reference. It should be understood that other constructions of the exhaust valves 90 are contemplated which would not deviate from the present invention. The two outlets 86 are connected to hoses 94. As seen in FIG. 4, the hoses 94 are connected to the crankcase 96 of the engine 24. Each hose 94 fluidly communicates with a crank chamber (not shown) inside the crankcase 96 (one crank chamber per cylinder 92) to supply lubricant to the crankshaft bearings (not shown) and the other components located therein. It should be understood that should the engine 24 have more or less cylinders 92, that the electronic oil pump 72A would have a number of outlets 84 and 86 that correspond to the number of cylinders. For example, should the engine 24 have three cylinders 92, then the electronic oil pump 72A would have three outlets 84 and three outlets 86. It is also contemplated that two electronic oil pumps 72A could be used should the number of outlets become too great for a single electronic oil pump 72A. It is also contemplated that the electronic oil pump 72A could provide lubricant only to the cylinders 92 (via the crankcase 96) and that the exhaust valves 90 would be lubricated in some other way. In this case, an electronic oil pump 72C having only two outlets 86 (for an engine 24 having two cylinders 92) as shown in FIGS. 7 and 8 would be used. It is also contemplated that the electronic oil pump 72A could provide lubricant to other components and parts of the engine 24.

Figure 5:
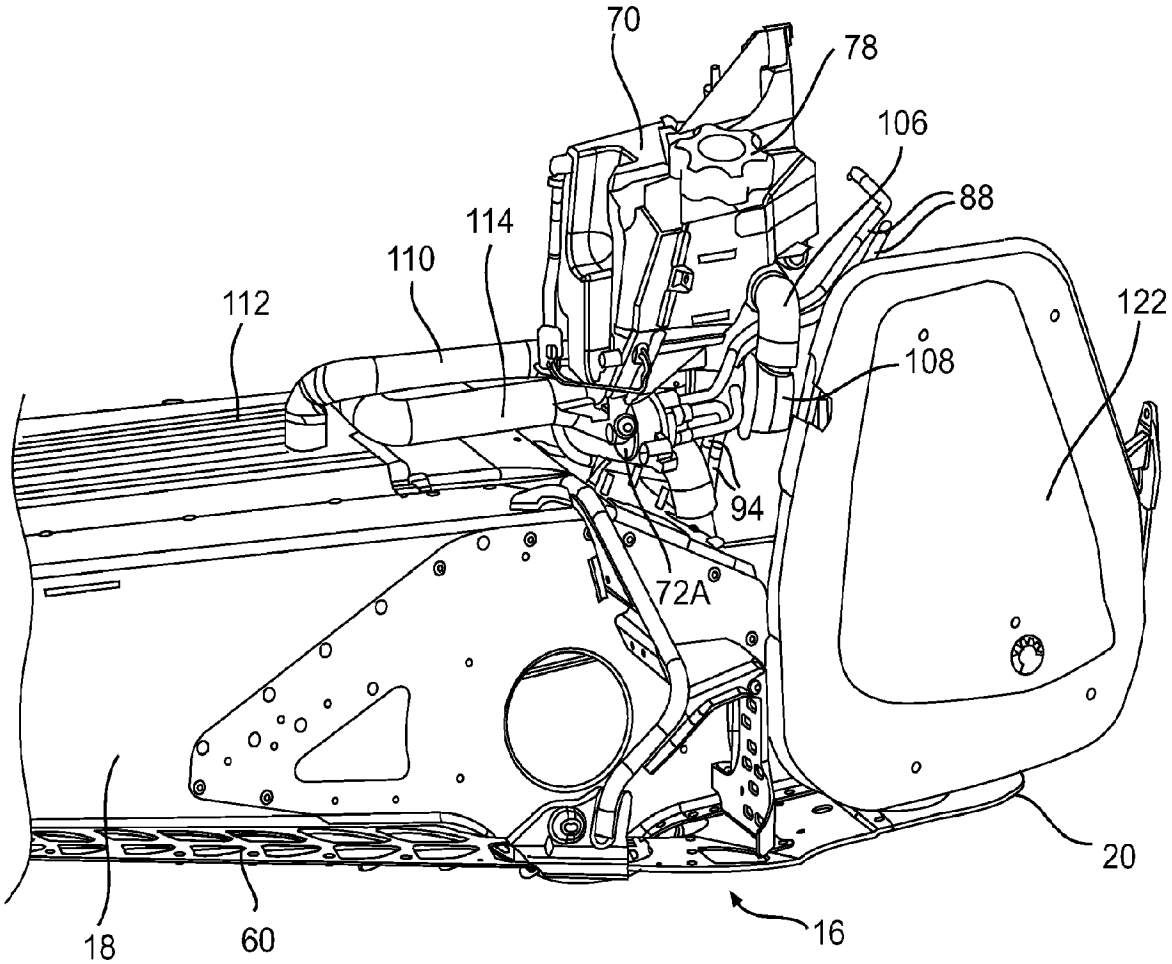
FIG. 5 is a perspective view from a rear, right side, of internal components of the snowmobile of FIG. 1, with some of the components removed for clarity.

Turning now to FIGS. 4 and 5, a cooling system, an exhaust system, and a positioning of the electronic oil pump 72A relative to these systems will be described. The cooling system has a coolant tank (not shown) that supplies coolant to the remainder of the system via pipe 98. Coolant can also flow back to the coolant tank via the pipe 98 when the coolant expands in the cooling system as the temperature of the coolant increase. Similarly, gas bubbles in the coolant system can flow to the coolant tank via pipe 98. Coolant in the system flows in coolant hose 100 to T-connector 102, and from T-connector 102 to coolant hose 104. From coolant hose 104, coolant enters coolant passages (not shown) inside the engine 24 thereby absorbing heat from the engine 24. The coolant then exits the engine 24 via coolant hose 106. From coolant hose 106, the coolant enters a thermostat 108. When the temperature of the coolant is below a predetermined temperature, the thermostat directs the coolant back to coolant hose 100, and from there the coolant is re-circulated through the engine 24 as described above. When the temperature of the coolant is above the predetermined temperature, the thermostat 108 prevents the coolant from entering coolant hose 100 and redirects the coolant to coolant hose 110. It is contemplated that the thermostat 108 could redirect only a portion of the coolant to coolant hose 110 and let a remainder of the coolant flow to coolant hose 100. From coolant hose 110, the coolant flows to a first heat exchanger 112 to be cooled. The first heat exchanger 112 forms the upper central part of the tunnel 18. From the first heat exchanger 112, the coolant flows to coolant hose 114. From coolant hose 114, the coolant flows to a second heat exchanger 116 (the majority of which is hidden by engine 24 in FIG. 4) located in the rear portion of the engine compartment 20 to be further cooled. It is contemplated that the first and second heat exchangers 112, 116 cooled be located elsewhere on the snowmobile 10 and that only one of the first and second heat exchangers 112, 116 could be used. From the second heat exchanger 116, coolant flows to coolant hose 118. From coolant hose 118, coolant flows to T-connector 102, to coolant hose 104, to the engine 24 to coolant hose 106 and back to thermostat 108 as described previously. The thermostat 108 causes the coolant to flow through the first and second heat exchangers 112, 116 until the temperature of the coolant is once again below the predetermined temperature.

The exhaust system receives exhaust gases from the exhaust ports 120 (FIG. 4) of the engine 24. The exhaust valves 90 regulate the flow of the exhaust gases through the exhaust ports 120. An exhaust manifold (not shown) is connected to the exhaust ports 120. The exhaust gases flow from the exhaust ports, through the exhaust manifold to a muffler 122 (FIG. 5). From the muffler 122 the exhaust gases flow through an exhaust pipe (not shown) to the atmosphere.

As can be seen in FIGS. 4 and 5, the electronic oil pump 72A is disposed in proximity to heat generating components of the snowmobile 10. These heat generating components include coolant hoses 110 and 114, heat exchanger 116, muffler 122, and engine 24. The coolant hoses 110 and 114, and heat exchanger 116 generate heat due to the hot coolant flowing through them. The muffler 122 generates heat due to the hot exhaust gases flowing through it. The engine 24 generates heat due to the combustion events taking place inside the cylinders 92. The electronic oil pump 72A is located proximate enough to these heat generating components that the heat generated by them, when the snowmobile 10 is in operation, heats up the lubricant contained in the electronic oil pump 72A. Therefore, by being heated, the lubricant maintains a viscosity level that allows it to be easily pumped by the electronic oil pump 72A. It is contemplated that locating the electronic oil pump 72A in proximity to at least one of these heat generating components could be sufficient to maintain the viscosity level of the lubricant in the electronic oil pump 72A.

Figure 6A:
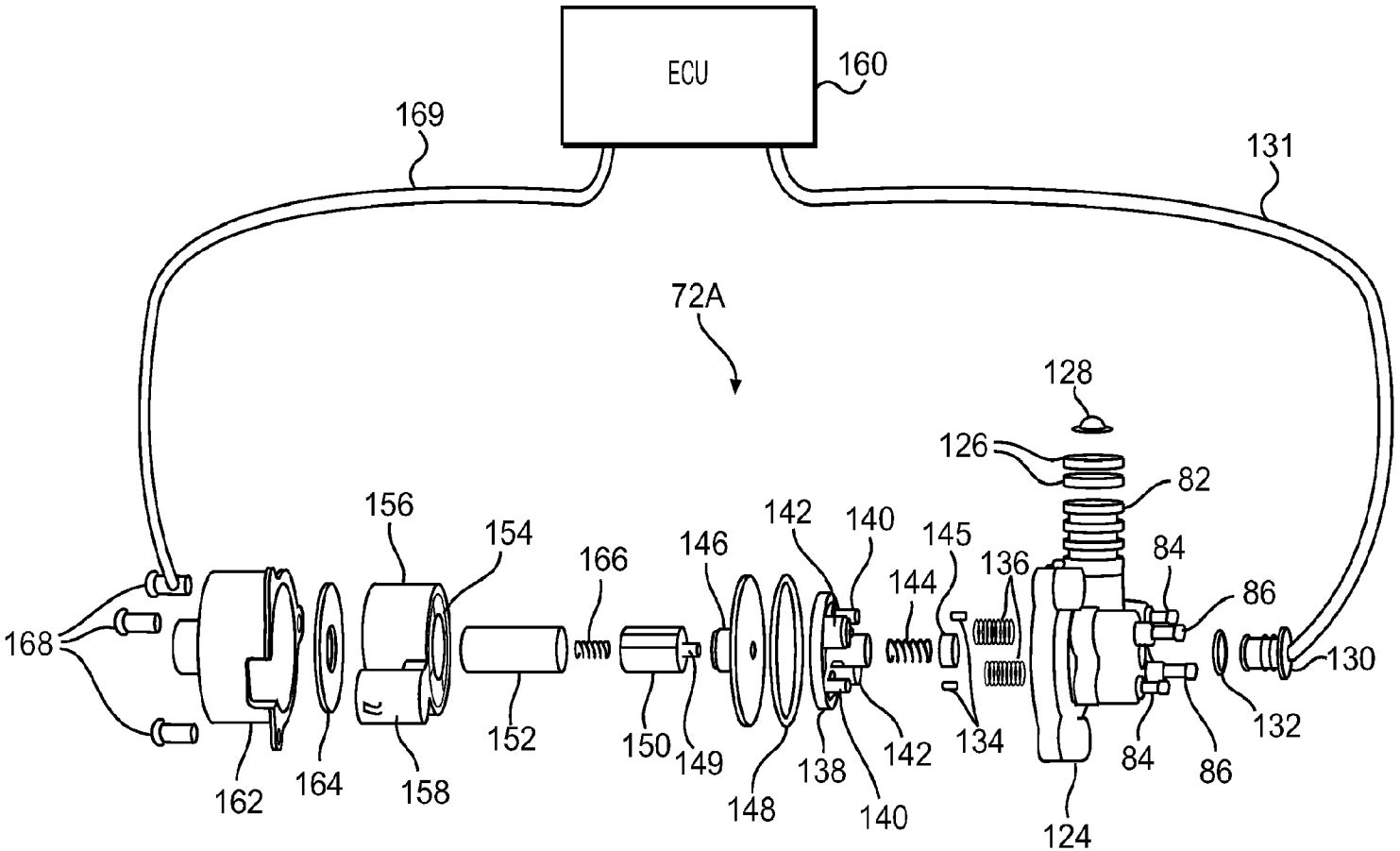
FIG. 6A is an exploded view of a first embodiment of the electronic oil pump used in the assembly of FIG. 2.

Turning now to FIG. 6A, details of the electronic oil pump 72A will be described. The electronic oil pump 72A is what is know as a reciprocating solenoid pump. The electronic oil pump 72A has a body 124 having the inlet 82 and the outlets 84, 86 integrally formed, over-molded, or press fit therewith. The body 124 is preferably made of plastic or other electrically insulating material. It is contemplated that the body could be made of an electrically conductive material covered with an electrically insulating material. Alternatively, the body could be made of an electrically conductive material and be provided with a sleeve therein made of electrically insulating material. As can be seen, the outlets 86 are larger than the outlets 84. This is because more lubricant needs to be supplied to the cylinders 92 by the outlets 86 than needs to be supplied to the exhaust valves 90 by the outlets 84. Two O-rings 126 are provided around the inlet 82 to prevent lubricant present in the oil tank 70 to seal the connection between the inlet 82 and the oil tank 70. A filter 128 is disposed in the inlet 82 to prevent debris from entering the electronic oil pump 72A. A stopper 130 is inserted in the body 124 centrally of the outlets 84, 86. A first electrical lead 131 electrically connects the stopper 130 to the ECU 160. It should be understood that the first electrical lead 131 may not connect the stopper 130 directly to the ECU 160. An O-ring 132 disposed around the stopper 130 seals the connection between the stopper 130 and the body 124. Check valves 134 are disposed in the passage of the outlets 84 to prevent lubricant from entering the body 124 via the outlets 84. Similarly, check valves 136 are disposed in the passage of the outlets 86 to prevent lubricant from entering the body 124 via the outlets 86. The check valves 134, 136 are sized according to the size of their corresponding outlets 84, 86. A piston carrier 138 has four pistons 140, 142 thereon. As can be seen the pistons 142 are larger than the pistons 140. The pistons 142 are used to pump lubricant through the larger outlets 86, and the pistons 140 are used to pump lubricant through the smaller outlets 84. A spring 144 is disposed between the piston carrier 138 and the stopper 130. A cap 145, made of plastic or other electrically insulating material, is disposed at the end of the spring 144, between the spring 144 and the stopper 130. The piston carrier 138 is connected to a plunger 149 of an armature 150. The plunger 149 extends through a pole 146. An O-ring 148 is provided around the pole 146 to prevent lubricant present in the body 124 from leaking into the section of the electronic oil pump 72A that is opposite the side of the pole 146 where the piston carrier 138 is connected (i.e. to the left of the pole 146 in FIG. 6A). The armature 150 is made of magnetizable material such as iron. The armature 150 is slidably disposed inside a sleeve 152. The sleeve 152 is disposed in the center of a coil bobbin 154 and is press-fitted over the pole 146. The coil bobbin 154 has a coil 156 wound around it. The ends of the coil 156 are connected to connector 158 which is used to connect the electronic oil pump 72A to the electronic control unit (ECU) 160 (see FIG. 4). The coil bobbin 154 is disposed inside a solenoid housing 162. The solenoid housing 162 is made of electrically conductive material. A washer 164 is disposed between the coil bobbin 154 and the end of the solenoid housing 162. A spring 166 is disposed between the armature 150 and the sleeve 152. Three threaded fasteners 168 are used to fastened the solenoid housing 162 to the body 124. When the solenoid housing 162 is fastened to the body 124, all of the components shown therebetween in FIG. 6A, except connector 158, are housed inside the volume created by the solenoid housing 162 and the body 124. A second electrical lead 169 electrically connects one of the fasteners 168 to the ECU 160. It should be understood that the second electrical lead 169 may not connect the one of the fasteners 168 directly to the ECU 160.

The electronic oil pump 72A operates as follows. Lubricant enters the body 124 via inlet 82. Current is applied to the coil 156 via the ECU 160, as will be described in greater detail below. The current applied to the coil 156 generates a magnetic field. The armature 150 slides towards the body 124 (to the right in FIG. 6A) under the effect of the magnetic field. The piston carrier 138 and the pistons 140, 142 move together with the armature 150. This movement of the armature also causes spring 144 to be compressed between the piston carrier 138 and the cap 145 and stopper 130. The movement of the pistons 140, 142 towards the body 124 compresses the lubricant contained in the body 124 and causes the lubricant to be expelled from the electronic oil pump 72A through the outlets 84, 86, via the check valves 134, 136. When the portion of the piston carrier 138 which houses the spring 144 makes contact with the stopper 130, an electrical path is created between the leads 131 and 169, thus closing the circuit formed by the leads 131 and 169, the pump 72A and the ECU 160. This signals the ECU 160 that the pump 72A has reached its full stroke position. Thus, the ECU 160 can determine the time it takes to reach the full stroke position by calculating the time elapsed between the time when current is applied to the coil 156 to the time when the electrical path between the leads 131 and 169 is closed. When the piston carrier 138 reaches this position, the lubricant has been expelled from the electronic oil pump 72A. The ECU 160 then stops applying current to the coil 156 which then no longer creates a magnetic field. Since the armature no longer applies a force to compress the spring 144, the spring 144 expands, thereby returning the pistons 140, 142, the piston carrier 138, and the armature 150 to their initial positions (towards the left in FIG. 6A) and opening the electrical path between the leads 131 and 169. The cap 145 provides electrical insulation between the stopper 130 and the spring 144, thereby preventing electrical connection between the leads 131 and 169 when the pump 72A is not in its full stroke position. The spring 166 prevents the armature 150 from hitting the end of the sleeve 152, which would generate noise and potentially damage the armature 150, and counteracts the force of the spring 144 to place the armature 150 in the correct initial position. By returning to their initial positions, the pistons 140, 142 create a suction inside the body 124. The suction 124, along with gravity, causes more lubricant to flow inside the body 124 via the inlet 82. The check valves 134, 136 prevent the lubricant that was expelled from the electronic oil pump 72A from re-entering the body via outlets 84, 86. Once the armature 150 returns to its initial position, the ECU 160 applies current to the coil 156 and the cycle is repeated.

It is contemplated that other types of electronic oil pumps could be used. For example, the armature 150 of the reciprocating electronic oil pump 72A described above could be replaced with a permanent magnet. In this embodiment, applying current in a first direction to the coil 156 causes movement of the permanent magnet, and therefore of the pistons 140, 142, in a first direction, and applying current in a second direction to the coil 156 causes movement of the permanent magnet in a second direction opposite the first one. Therefore, by being able to control the movement of the permanent magnet in both direction, this type of pump provides additional control over the reciprocating motion of the pump when compared to the solenoid pump 72A described above.

Figure 6B:
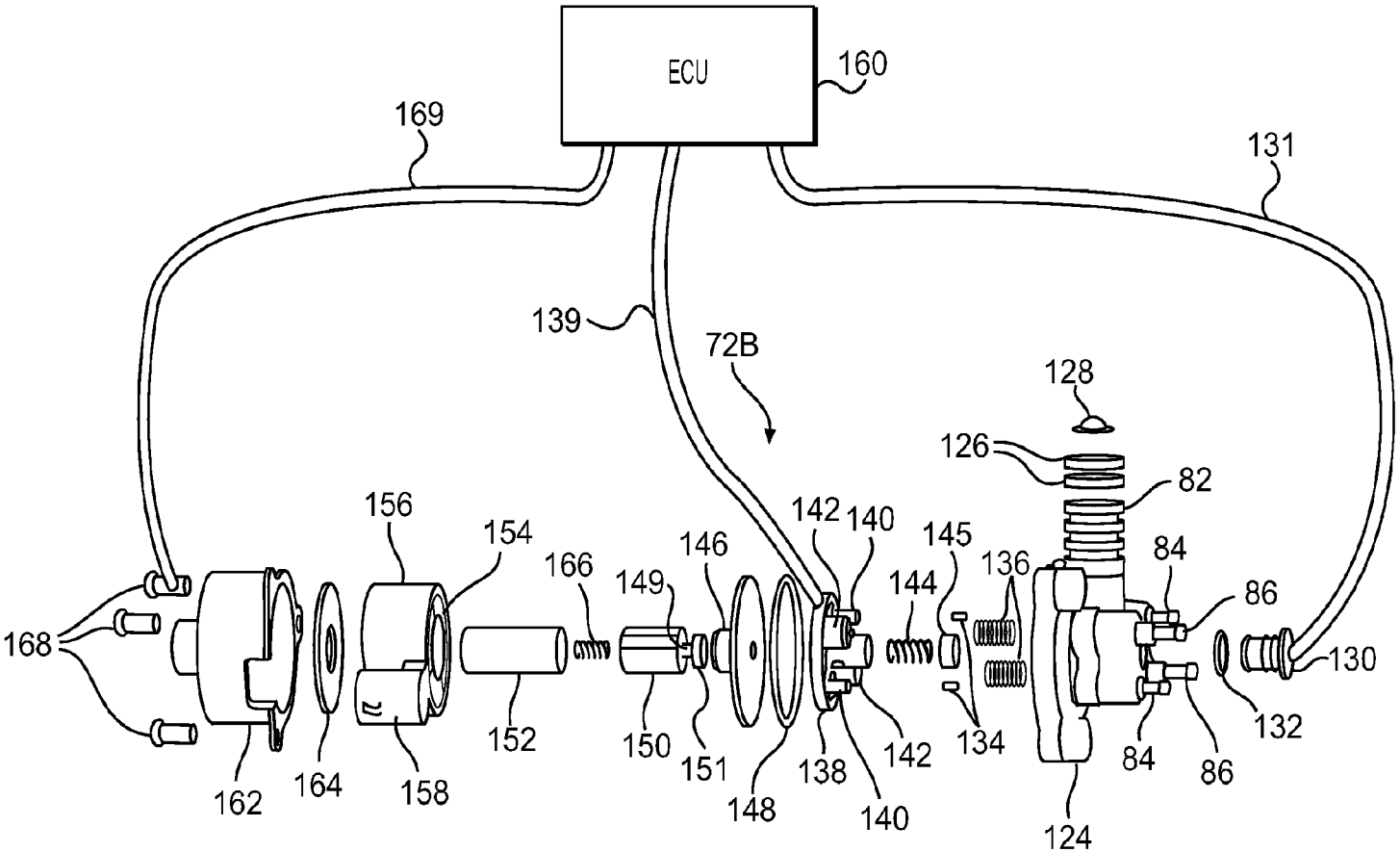
FIG. 6B is an exploded view of a second embodiment of the electronic oil pump used in the assembly of FIG. 2.

FIG. 6B illustrates an alternative embodiment of the pump 72A, pump 72B. The pump 72B has all of the elements of the pump 72A with the addition of a cap 151 and a third lead 139. The third lead 139 electrically connects the piston carrier 138 to the ECU 160. It should be understood that the third electrical lead 139 may not connect the piston carrier 138 directly to the ECU 160. The cap 151, which is made of plastic or other electrically insulating material, is disposed at the end of the plunger 149, between the plunger 149 and the piston carrier 138. When the piston carrier 138 makes contact with the pole 146, an electrical path is created between the leads 139 and 169, thus closing the circuit formed by the leads 139 and 169, the pump 72A and the ECU 160. This signals the ECU 160 that the pump 72B has reached its fully retracted position. The cap 151 provides electrical insulation between the piston carrier 138 and the plunger 149, thereby preventing electrical connection between the leads 139 and 169 when the pump 72B is not in its fully retracted position. Thus, the ECU 160 can determine the time it takes to reach a full stroke by calculating the time elapsed between the time when the electrical path between the leads 139 and 169 is opened to the time when the electrical path between the leads 131 and 169 is closed. Similarly, the ECU 160 can determine the time it takes to reach the fully retracted position by calculating the time elapsed between the time when the electrical path between the leads 131 and 169 is opened to the time when the electrical path between the leads 139 and 169 is closed.

Figure 9:
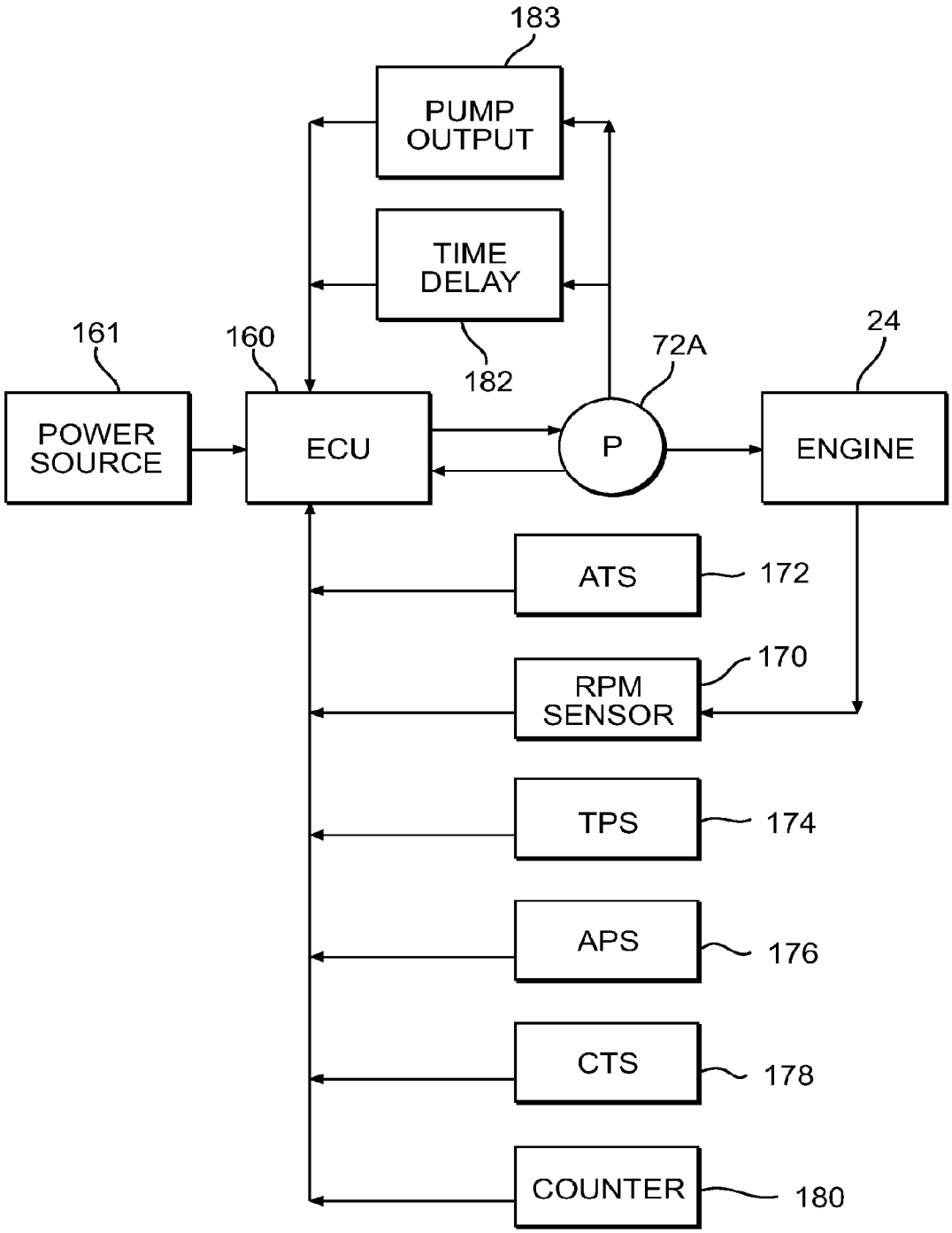
FIG. 9 is a schematic illustration of some of the various sensors and components present in the snowmobile of FIG. 1.

As described above, the ECU 160 is electrically connected to the connector 158 of the electronic oil pump 72A to supply current to the coil 156 and the ECU 160 also receives a feedback from the oil pump 72A via leads 131 and 169. The ECU 160 is connected to a power source 161 (FIG. 9) and, based on inputs from one or more of the various sensors described below with respect to FIG. 9, regulates when current from the power source 161 needs to be applied to the electronic oil pump 72A such that the proper amount of lubricant is supplied to the cylinders 92 of the engine 94. As seen in FIG. 9, an engine speed sensor (RPM sensor) 170 is connected to the engine 24 and is electrically connected to the ECU 160 to provide a signal indicative of engine speed to the ECU 160. The engine 24 has a toothed wheel (not shown) disposed on and rotating with a shaft of the engine 24, such as the crankshaft (not shown) or output shaft (not shown). The engine speed sensor 170 is located in proximity to the toothed wheel (see FIG. 4 for example) and sends a signal to the ECU 160 each time a tooth passes in front it. The ECU 160 then determines the engine rotation speed by calculating the time elapsed between each signal. An air temperature sensor (ATS) 172 is disposed in an air intake system of the engine 24, preferably in an air box (not shown), and is electrically connected to the ECU 160 to provide a signal indicative of the ambient air temperature to the ECU 160. A throttle position sensor (TPS) 174 is disposed adjacent a throttle body or carburetor (not shown), as the case may be, of the engine 24 and is electrically connected to the ECU 160 to provide a signal indicative of the position of the throttle plate inside the throttle body or carburetor to the ECU 160. An air pressure sensor (APS) 176 is disposed in an air intake system of the engine 24, preferably in an air box (not shown), and is electrically connected to the ECU 160 to provide a signal indicative of the ambient air pressure to the ECU 160. A coolant temperature sensor (CTS) 178 is disposed in the cooling system of the engine 24, preferably in one of coolant hoses 100, 104, or 106, and is electrically connected to the ECU 160 to provide a signal indicative of the temperature of the coolant to the ECU 160. It is contemplated that the CTS 178 could be integrated to the thermostat 108. A counter 180 is electrically connected to the ECU 160. The counter 180 can be in the form of a timer and provide a signal indicative of time to the ECU 160. The counter 180 could also count the number of times the electronic oil pump 72A has been actuated. The counter 180 could also be linked to the engine 24 to provide a signal indicative of the number of rotations of a shaft of the engine 24 to the ECU 160. It is contemplated that the RPM sensor 170 could integrate the function of the counter 180 to provide a signal indicative of the number of rotations of a shaft of the engine 24 to the ECU 160 in addition to the signal indicative of engine speed. It is also contemplated that there could be two (or more) counters 180, one acting as a timer, and the other counting the number of rotations of the engine 24 or the number of times the electronic oil pump 72A has been actuated.

The electronic oil pump 72A has an inherent time delay that is determined by an elapsed time from the time an electric current is received by the electronic oil pump 72A from the ECU 160 to the time that lubricant is actually initially expelled from the electronic oil pump 72A. Due to manufacturing tolerances, this time delay varies from one electronic oil pump 72A to the other. Therefore, the electronic oil pump 72A has a specific time delay 182 associated therewith. The time delay 182 is stored on a computer readable storage medium, such as a bar code or a RFID tag, associated with the electronic oil pump 72A. The time delay 182 is provided to the ECU 160 and is taken into account when regulating the application of current to the electronic oil pump 72A such that the actual operation of the electronic oil pump 72A corresponds to the desired operation of the electronic oil pump 72A as calculated by the ECU 160. An example as to how this is achieved for fuel injectors, and which could be adapted for use on electronic oil pumps, is described in U.S. Pat. No. 7,164,984, issued Jan. 16, 2007, the entirety of which is incorporated herein by reference. In oil pump 72B, this time delay does not need to be provided since the time at which lubricant is actually initially expelled from the electronic oil pump 72B corresponds to when the electrical path between the leads 139 and 169 is opened.

Due to manufacturing tolerances, the amount of lubricant being expelled per stroke by the electronic oil pump 72A varies from one electronic oil pump 72A to the other. Therefore, the electronic oil pump 72A has a specific pump output 183 associated therewith that corresponds to the actual amount of lubricant being expelled per stroke by the electronic oil pump 72A. The pump output 183 is stored on a computer readable storage medium, such as a bar code or a RFID tag, associated with the electronic oil pump 72A. The computer readable storage medium could be the same as the one used for the time delay 182 or could be a different one. The pump output 183 is provided to the ECU 160 and is taken into account when regulating the application of current to the electronic oil pump 72A such that the actual operation of the electronic oil pump 72A corresponds to the desired operation of the electronic oil pump 72A as calculated by the ECU 160. It is contemplated that only one of the time delay 182 and the pump output 183 may be provided for the electronic oil pump 72A.

Figure 10:
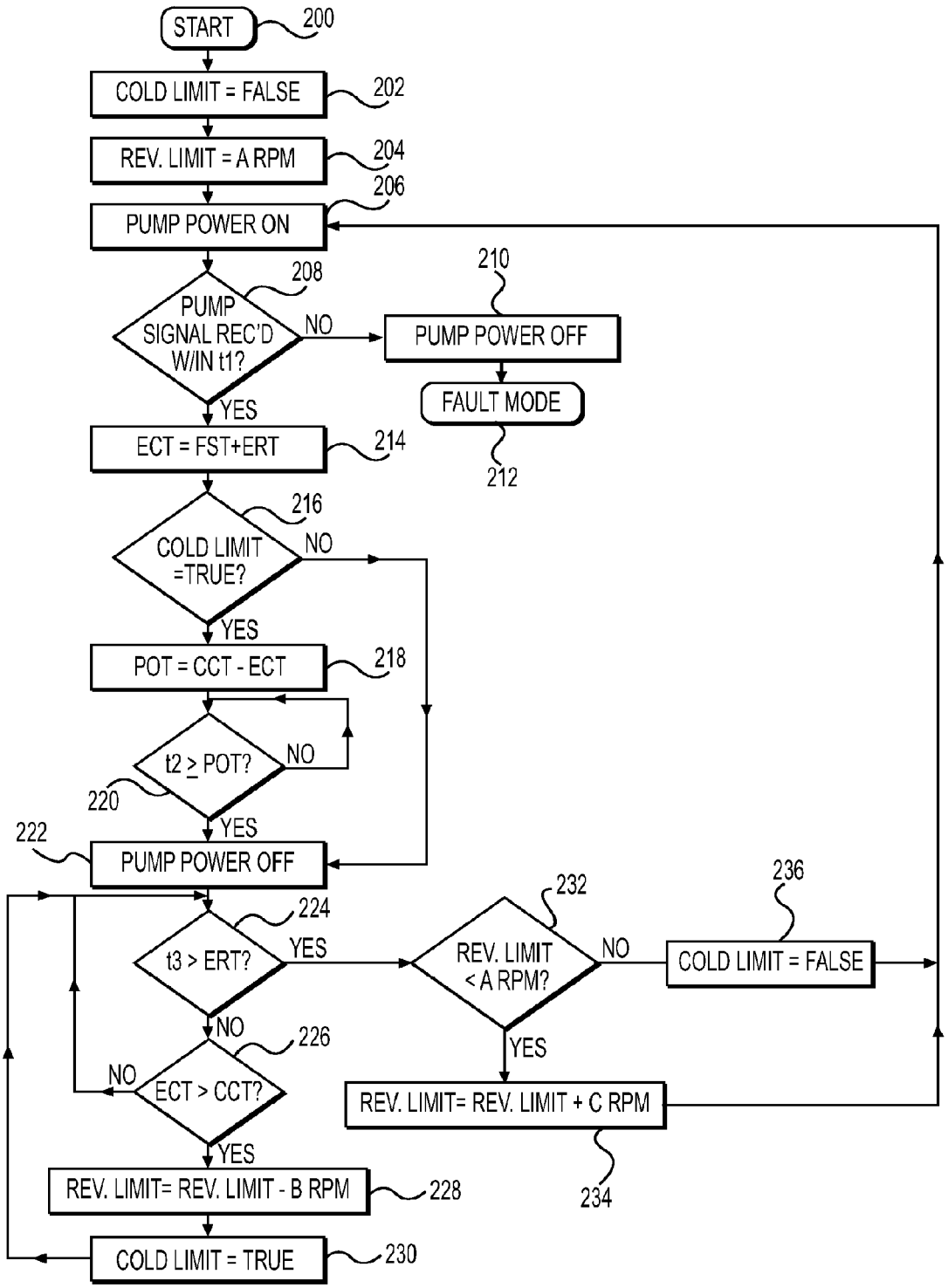
FIG. 10 is a logic diagram illustrating a control of the electronic oil pump.

Turning now to FIG. 10, a method of controlling the electronic oil pump 72A will be described. A method of operating the electronic oil pump 72B is the same as the method of operating the electronic oil pump 72A, unless specifically explained otherwise below.

The method is initiated at step 200, once the key (not shown) is inserted in the snowmobile 10 or once the engine 24 is started. In the present method, a boolean variable called "Cold Limit" is used to indicate whether the lubricant being used by the pump 72A has a viscosity which is higher than expected during normal operation of the snowmobile 10. A "Cold Limit" which is set to "true" indicates such a higher viscosity. A "Cold Limit" which is "false" indicates that the lubricant has a viscosity within a range which is expected during normal operation of the snowmobile. As previously explained, a low lubricant temperature would result in a high viscosity of the lubricant (herein the name "Cold Limit"). Although the name of the boolean variable "Cold Limit" suggests a relationship with temperature, it should be understood that using a lubricant which has a high viscosity, even at normal operating temperatures of lubricant in a snowmobile 10, could also result in the boolean variable "Cold Limit" being set to "true" during the present method. At step 202, the boolean variable "Cold Limit" is set to false since no data is available at this point to determine otherwise. Then at step 204, the ECU limits the maximum engine speed to a value of A RPM, which corresponds to an engine speed limit during normal operation of the snowmobile 10.

At step 206, the ECU 160 then applies current to the coil 156 of the oil pump 72A. Then at step 208, the ECU 160 determines if a signal which indicates that the circuit including the leads 131 and 169 is closed is received within a predetermined time limit t1. As previously described, this signal is indicative that the that the pump 72A has reached its full stroke position. If the signal is not received within t1, then at step 210 the ECU 160 stops applying current to the coil 156 of the oil pump 72A to return the oil pump 72A to its fully retracted position. Since not receiving a signal within t1 at step 208 indicates that the oil pump 72*a* is unable to reach its full stroke position, and therefore unable to efficiently pump lubricant, at step 212 the ECU 160 enters a fault operation mode. The problem could be that one of the components of the pump 72A is faulty or that the lubricant inside the oil pump 72A is too viscous for the oil pump 72A to pump the lubricant. The fault operation mode limits the performance of the engine 24 so as to prevent damaging the engine 24. It is contemplated that the ECU 160 could also enter a fault mode if a signal which indicates that the circuit including the leads 131 and 169 is closed is received in less than another predetermined time limit, which would indicate that there is no lubricant present in the oil pump 72A. If at step 208, a signal is received within the time t1, then the ECU 160 continues to step 214.

At step 214, the ECU 214 determines the estimated cycle time (ECT). The estimated cycle time corresponds to the sum of the time it took the pump 72A to reach its full stroke position (full stroke time, FST) and of the estimated time it will take the pump 72A to reach it fully retracted position (estimated return time, ERT). The full stroke time is determined from the time it took to receive the signal from the circuit including the leads 131 and 169 that the circuit is closed as described above. The estimated return time is determined from various experimentally determined maps stored in the ECU 160 or other electronic storage devices accessible by the ECU 160. The maps provide estimated return times for various full stroke times. Should the full stroke time not correspond to a value in the maps, the ECU 160 can interpolate the estimated return time from two known values in the maps. As previously described, a long full stroke time is indicative of a high lubricant viscosity. A high lubricant viscosity, as should be understood, makes it more difficult for the pump 72A to suck lubricant back inside the pump 72A. Therefore, the longer the full stroke time is, the longer the estimated return is. In a method using the oil pump 72B, the estimated return time only needs to be determined in this manner (i.e. using maps) the first time step 214 is performed. When the step 214 is subsequently performed, the estimated return time used is the time elapsed between the circuit including the leads 131 and 169 becoming opened and the circuit including the leads 139 and 169 becoming closed. As should be understood, the estimated cycle time determined at step 214 determines the maximum frequency at which the pump 72A can be used.

From step 214, the ECU 160 continues to step 216 and determines if the "Cold Limit" variable has a value of "true". The first time step 216 is performed, the value of the "Cold Limit" variable is "false" and the method continues to step 222 where the ECU 160 stops applying current to the coil 156 of the oil pump 72A to return the oil pump 72A to its fully retracted position. When step 216 is subsequently performed, if the value of the "Cold Limit" variable is "true" as a result of step 230 described below, then the ECU 160 continues to step 218. As previously described, when the "Cold Limit" variable is "true", it is as a result of the lubricant having a high viscosity, which can be caused by the lubricant being at a low temperature. As should be understood, the viscosity of the lubricant can therefore be reduced by heating the lubricant. As described in more detail in PCT application no. PCT/US2008/055477, published as WO 2009/002572 A1 on Dec. 31, 2008, the entirety of which is incorporated herein by reference, by continuing to apply current to the coil 156 after the pump 72A has reached its full stroke position, the coil 156 generates heat which can help reduce the viscosity of the lubricant. At step 218, the ECU 160 determines a maximum amount of time (power-on time, POT) for which the current can be applied to the coil 156 of the pump 72A before having to return the oil pump 72A to its fully retracted position in order to initiate the next pumping cycle. The power-on time corresponds to the difference between the calculated cycle time (CCT) and the estimated cycle time (ECT) determined at step 214. The calculated cycle time is the cycle time at which the pump 72A needs to be operated in order to supply the amount of lubricant required by the engine 24 at the current operating conditions. The ECU 160 uses the signals received from at least some of the sensors described above with respect to FIG. 9, including the engine speed sensor 170, to calculate the calculated cycle time. International publication WO 2009/002572 A1 describes some methods in which the cycle time can be calculated by the ECU 160, but other methods are contemplated. Generally, the faster the engine speed is, the shorter the calculated cycle time will be, however the relationship between the engine speed and the calculated cycle time does not need to be a linear one. From step 218, the ECU 160 continues to step 220 where it determines if the amount of time elapsed since the current has been applied to the coil 156 of the pump 72A (time t2) is greater than or equal to the power-on time. If it is not, then the ECU 160 will continue to loop back to step 220 until that is the case. Once the time t2 is greater than or equal to the power-on time, the ECU 160 continues to step 222 where the ECU 160 stops applying current to the coil 156 of the oil pump 72A to return the oil pump 72A to its fully retracted position.

From step 222, the ECU 160 continues to step 224. At step 224 the ECU 160 determines if the amount of time elapsed since step 222 (time t3) is greater than the estimated return time determined at step 214. As should be understood, the time t3 also corresponds to the amount of time elapsed since the circuit including the leads 131 and 169 has been opened. If at step 224, the time t3 is greater than the estimated return time, then the ECU 160 continues to step 232. If at step 224, the time t3 is not greater than the estimated return time, then at step 226 the ECU 160 determines if the estimated cycle time determined at step 214 is greater than the calculate cycle time (which is calculated as described above with respect to step 218). If the estimated cycle time is not greater than the calculated cycle time, then the pump 72A can adequately supply lubricant to the engine 24 under the current operating conditions (i.e. the pump 72A can perform a complete pumping cycle faster than what is required) and the ECU 160 returns to step 224. If however, the estimate cycle time is greater the calculated cycle time, then the pump 72A cannot adequately supply lubricant to the engine 24 (i.e. the pump 72A cannot perform a complete pumping cycle within the required amount of time) and the ECU 160 continues to step 228. At step 228 the ECU reduces the maximum allowable engine speed by an amount of B RPM (10 RPM for example), and then sets the "Cold Limit" variable to "true" such that when the method subsequently comes to step 216, steps 218 and 220 will be performed to warm the lubricant as described above. From step 230, the ECU 160 returns to step 224 and if the time t3 is not greater than the estimated return time, then step 226 is performed again. If the engine 24 was previously operating at a speed greater than the maximum allowable engine speed calculated at step 228, then the engine speed has been reduced and therefore the calculated cycle time should have increased. If at step 226 the estimated cycle time is still not greater than the calculated cycle time, then step 228 is repeated. Step 228 will continue to be performed until either the time t3 is greater than the estimated return time (step 224) or the estimated cycle time is greater than the calculated cycle time (step 226), whichever occurs first.

In a method using the oil pump 72B, step 224 could be replace by a step where the ECU 160 determine if a signal indicative that the circuit including the leads 139 and 169 has been closed has been received. If this circuit is opened, then the ECU 160 continues to step 226 and if it is closed the ECU 160 continues to step 232.

Once it is determined at step 224 that the time t3 is greater than the estimated return time, then at step 232 the ECU determines if the maximum allowable engine speed is less than the engine speed limit during normal operation of the snowmobile 10 of A RPM. If it is not less than A RPM, then the ECU 160 continues to step 236, set the value of the variable "Cold Limit" to false, and then returns to step 206 where it will apply current to the coil 156 of the pump 72A at the beginning of the next pumping cycle. If the maximum allowable engine speed is less than A RPM, the ECU will increase the maximum allowable engine speed by a predetermined amount of C RPM (but without exceeding A RPM), so as to gradually increase the maximum allowable engine speed each time step 234 is performed. From step 234 the ECU 160 returns to step 206 where it will apply current to the coil 156 of the pump 72A at the beginning of the next pumping cycle.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A method of controlling an engine having an electronic oil pump supplying lubricant thereto, the electronic oil pump including an actuator operatively connected to at least one piston, the method comprising:

causing the actuator to move the at least one piston toward a full stroke position;

sending a first signal to an electronic control unit (ECU) when the at least one piston reaches the full stroke position;

determining a time taken to reach the full stroke position based on the first signal;

returning the at least one piston to the fully retracted position;

sending a second signal to the ECU when the at least one piston reaches a fully retracted position;

determining a time taken for returning the at least one piston to the fully retracted position based on the second signal;

determining a cycle time of the pump based on the time taken to reach the full stroke position and the time taken for returning the at least one piston to the fully retracted position; and limiting a maximum allowable engine speed based at least in part on the cycle time.

2. The method of claim 1, wherein the actuator includes an electromagnetic coil;

wherein causing the actuator to move the at least one piston toward a full stroke position includes applying a current to the electromagnetic coil; and wherein returning the at least one piston to the fully retracted position includes stopping to apply the current to the electromagnetic coil.

3. The method of claim 2, further comprising applying the current to the electromagnetic coil for longer than is necessary to move the at least one piston toward the full stroke position.

4. The method of claim 1, further comprising operating the engine in a fault mode if the first signal is not received by the ECU within a predetermined amount of time.

* * * * *